US005375699A

United States Patent [19]

Amend

[11] Patent Number: 5,375,699

[45] Date of Patent: Dec. 27, 1994

[54] PLASTIC CONTACT LENS CASE

[76] Inventor: Udo Amend, Maerchenring 49, D-76199 Karlsruhe, Germany

[21] Appl. No.: 157,236

[22] Filed: Nov. 24, 1993

[30] Foreign Application Priority Data

Nov. 25, 1992 [EP] European Pat. Off. ..... 92120046.5

[51] Int. Cl.[5] ..... A45C 11/04

[52] U.S. Cl. ..... 206/5.1; 134/901

[58] Field of Search ..... 206/5.1, 6; 134/901

[56] References Cited

U.S. PATENT DOCUMENTS

| | | | |
|---|---|---|---|
| 2,877,779 | 3/1959 | Bromberg | 139/901 X |
| 3,186,540 | 6/1965 | Breger . | |
| 4,337,858 | 7/1982 | Thomas et al. | 206/5.1 |
| 4,406,362 | 9/1983 | Thomas . | |
| 4,574,944 | 3/1986 | Gregory | 206/5.1 |
| 4,823,944 | 4/1989 | Ryder | 206/5.1 |
| 5,129,999 | 7/1992 | Holland et al. | 206/5.1 X |

FOREIGN PATENT DOCUMENTS

| | | | |
|---|---|---|---|
| 1468629 | 1/1967 | France . | |
| 2494571 | 5/1982 | France . | |
| 47-36784 | 9/1972 | Japan | 206/5.1 |
| 1197161 | 7/1970 | United Kingdom . | |

*Primary Examiner*—Bryon P. Gehman
*Attorney, Agent, or Firm*—Spencer, Frank & Schneider

[57] ABSTRACT

A plastic contact lens case serves to keep contact lenses in fluid and comprises a lower member, a movable cover, and an intermediate plate which is pivotably arranged therebetween. The lower member is provided with two receptacles for a pair of contact lenses. The receptacles are provided with circumferential annular grooves and sealing rings inserted therein. In the closed state of the contact lens case, the intermediate plate sealingly contacts the sealing rings of the lower member. The result of these features is a contact lens case of an especially compact construction, it accommodates delicate contact lenses and simultaneously ensures that no fluid escapes from the filled receptacles.

8 Claims, 2 Drawing Sheets

PLASTIC CONTACT LENS CASE

CROSS REFERENCE TO RELATED APPLICATION

This application claims the priority of European Patent application No. EP 92,120,046.5 filed Nov. 25, 1992, the subject matter of which is incorporated herein by reference.

BACKGROUND OF THE INVENTION

The present invention relates to a plastic contact lens case having a lower member, which is provided with two receptacles for keeping contact lenses in fluid, and a hinged cover.

The proposed contact lens case is intended for contact lens wearers who wish to remove their contact lenses while travelling, and clean and/or replace them, and who must bring along the required paraphernalia such as a contact lens case, fluid, mirror and suction holder.

Plastic contact lens cases are known. They comprise a lower member and two inner vessels for fluid, which are set into the lower member and have a screw-on cover. Disadvantages of these cases are that the inner vessels must be opened and closed by means of small, difficult-to-manipulate covers and, in addition to the contact lens case itself, auxiliary means must be carried along for handling the lenses.

Cases for contact lenses and bottles for fluid having generous dimensions are also known which, for this reason alone, are not suitable as constant companions to a person wearing contact lenses. Also, problems relating to tightness frequently occur with this type of fluid-holding container.

SUMMARY OF THE INVENTION

An object of the invention is therefore a concept for an easily manipulatable contact lens case which is built as compactly as possible, is able to hold the delicate contact lenses in fluid, and also ensures that in the closed state no fluid escapes.

This object is attained in accordance with the invention in that in a contact lens case of the type mentioned above, annular grooves are provided which encircle the upper edge of the receptacles, that sealing rings are placed in the annular grooves, and that, between the lower member and the cover, a pivotable intermediate plate is arranged which, in the closed state of the contact lens case, contacts the sealing rings in a sealing manner. These features result in a contact lens case, which is absolutely fluid tight, is unique due to its extremely compact construction, and simultaneously facilitates handling. The receptacles for the contact lenses are easily accessible in that, after opening the cover, the intermediate plate is pivoted upward. To close the receptacles, the intermediate plate is simply pivoted downward again and the cover is closed.

In one of the embodiments of the invention the receptacles are configured as cylindrical bowls and are therefore optimally matched to the round shape of the contact lenses. This results in the consumption of only a minimum of the costly fluid for keeping the lenses cared for and cleaned.

In another embodiment, especially intended for soft contact lenses, the receptacles are configured as round recesses in the upper face of the lower member. If required, these receptacles may also accommodate special baskets into which the contact lenses are inserted. Of course, the hollow interior space of the lower member must first be filled with a disinfecting solution and—in the case of a two-component system—a neutralizing tablet must be added.

In a preferred embodiment, the sealing rings are configured as O-rings of an elastic plastic. Due to the elasticity of the sealing rings, a reliable seal is ensured between the edges of the receptacles and the movable intermediate plate so that no fluid escapes. Due to the elasticity of the O-ring material, however, it is possible for oxygen which forms, for example, if a neutralizing tablet is used, escapes from the lower member.

A recess for a suction holder is advantageously provided in the lower member. On account of this feature, the suction holder can always be carried along. It is used to remove the contact lenses from the receptacles and to place them on the eye or vice versa without contamination by the fingers.

In an expedient embodiment, a catch mechanism is provided on the front face for releasably latching the cover to the lower member. The catch mechanism keeps the contact lens case under a certain locking pressure in the closed state, with the locking force corresponding to the required pressure force which must act on the sealing rings for absolute fluid tightness.

On its inner side, the cover is preferably provided with a mirror. The mirror may be set into a flat recess of the cover. The mirror, which must accompany the container, is thus accommodated in a space-saving manner in order to make it easier for the person wearing the contact lenses to handle the contact lenses during insertion and removal, regardless of the respective environment.

In an advantageous further modification, the cover is provided with a peripheral edge which encloses the intermediate plate. This feature reduces the height of the contact lens case and thus contributes to the extremely compact construction.

The configuration of the intermediate plate is advisably planar, thus realizing, by way of the sealing rings, a flawless seal in relation to the edges of the receptacles. Moreover, a planar intermediate plate can be manufactured in an especially simple manner.

The lower member, the cover and the intermediate plate may be provided with a common hinge axis. Such a common hinge axis is advantageous, both for manipulating and manufacturing the contact lens case.

In a preferred embodiment, the lower member, the cover and the intermediate plate are injection molded from plastic. This ensures the simple and cost-effective production of these three shaped members.

BRIEF DESCRIPTION OF THE DRAWINGS

An embodiment of the invention is elucidated below in greater detail and by way of the attached drawings in which.

DETAILED DESCRIPTION OF THE PREFERRED EMBODIMENTS

Figure 1:
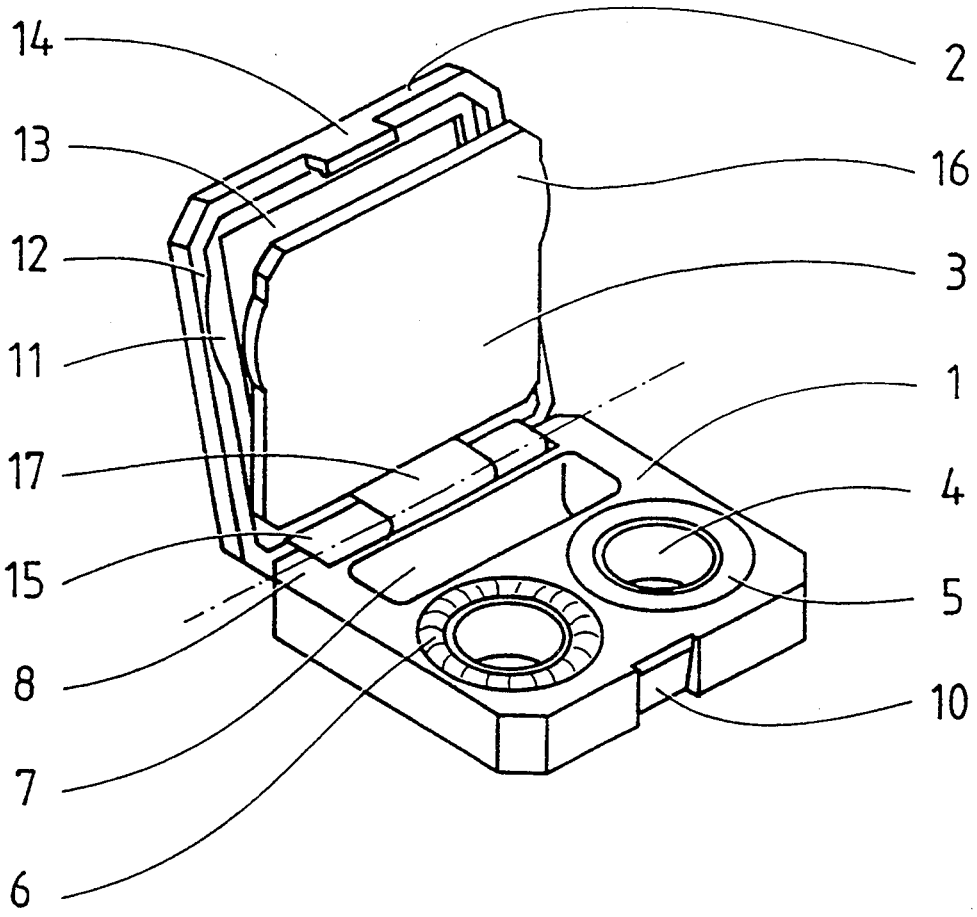
FIG. 1 is a perspective enlarged top view of the contact lens case in the open state seen obliquely from the top.
Figure 2:
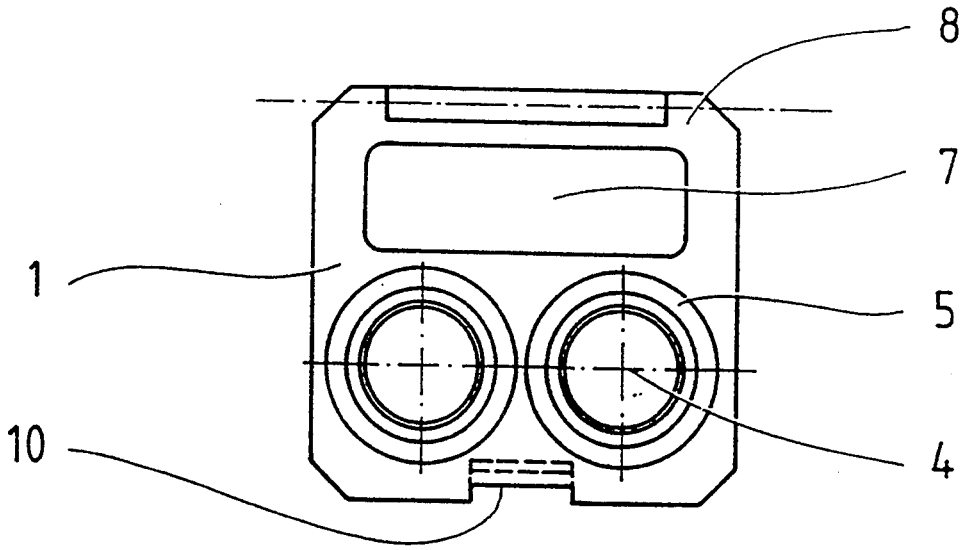
FIG. 2 is a side view of the opened contact lens case.

The contact lens case shown in FIGS. 1 and 2 essentially comprises three plastic members; a lower member 1, a cover 2 and an intermediate plate 3.

Figure 3:
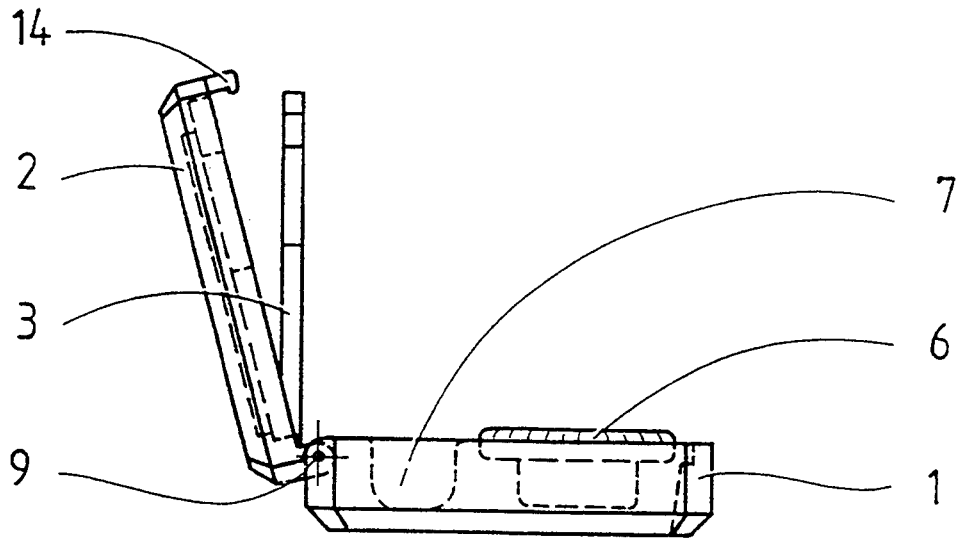
FIG. 3 is a top view of the lower member of the contact lens case.

The lower member 1 is shown here as a planar, rectangular block (see FIG. 3). To accommodate the contact lenses in fluid, the lower member 1 is provided in its forward region with two cylindrical receptacles 4 having a planar bottom. The interior dimension of the receptacles 4 is only slightly larger than the diameter of the (non-illustrated) dish-shaped contact lenses. An annular groove 5 encircles the upper edge of each one of the two receptacles 4 respectively. An elastic sealing ring 6 having a circular cross section, is inserted into each annular groove 5 and projects slightly upwardly over the planar surface of the lower member 1. In the rearward region of the lower member 1, an elongate trough-shaped recess 7 is molded in for a non-illustrated suction holder. On the rearward side of the lower member 1 two projections 8, in which a through-going axial metal hinge pin 9 is supported, are molded to the corner regions. The front face of the lower member 1 is provided with a central recess 10.

The interior face of cover 2 is provided with a flat rectangular recess 11 and an edge 12 which surrounds it and is directed downward. A mirror 13 is set into the recess 11. A locking hook 14 is molded to the front face of the cover 2 in the center of the edge 12 and projects downward. Two symmetrically arranged articulated lugs 15 are arranged at the rear face of the cover 2 and accommodate the hinge pin 9.

The outline of the planar intermediate plate 3 corresponds to the dimension of the sealing rings 6 and their distance from one another. This results in a broadened region of the intermediate plate 3 above the fluid receptacles which is due to projections 16 at both sides of the contact lens case. Due to the reduced wall thickness of the corresponding section of the edge 12, the recess 11 of the cover corresponds to these projections 16 such that the entire intermediate plate 3 may be accommodated by the cover 2. A mounting lug 17 is shaped to the side facing the hinge pin 9.

The lower member 1, the cover 2, and the intermediate plate 3 are connected to one another by the mutual hinge pin 9, and they are mounted to be simultaneously pivotable (see FIG. 2). As a result, the cover 2 may be pivoted upward approximately over a 100° angle. The intermediate plate 3 is freely movable from a lose placement on the lower member 1 to a complete pivoting into the cover 2. During closure of the cover 2, the intermediate plate 3 automatically accompanies it until it contacts the sealing rings 6.

If the contact lens case is completely closed, the locking hook 14 on the cover 2 slides over the front face of the lower member 1 and engages in its recess 10. The locking hook 14 may be pressed upward with the thumb or index finger against a certain resistance over the front face of the lower member 1, thus making it possible for the contact lens case to be opened again.

It will be understood that the above description of the present invention is susceptible to various modifications, changes an adaptations, and the same are intended to be comprehended within the meaning and range of equivalents of the appended claims.

What is claimed is:

1. In a contact lens case made of plastic and comprising a lower member which is provided with two receptacles for keeping contact lenses in fluid, and with a movable cover having a hinge connection with the lower member, the improvement wherein: each receptacle has an upper edge which is surrounded by an annular groove; sealing rings are set into said annular grooves; and an intermediate plate is pivotably attached to said case between the lower member and the cover at a common pivot axis with the lower member and the cover and in a closed state of the contact lens case, said intermediate plate sealingly contacts the sealing rings.

2. Contact lens case as defined in claim 1, wherein the receptacles comprises cylindrical bowls.

3. Contact lens case as defined in claim 1, wherein the lower member has an upper face and the receptacles comprise round recesses in said upper face.

4. Contact lens case as defined in claim 1, wherein the sealing rings comprise O-rings of an elastic plastic material.

5. Contact lens case as defined in claim 1 wherein a recess for a suction holder is provided in the lower member.

6. Contact lens case as defined in claim 1, wherein the case has a front face and a catch mechanism for releasably locking the cover to the lower member is provided on said front face.

7. Contact lens case as defined in claim 1, wherein the cover has an interior face and further including a mirror disposed on said interior face.

8. Contact lens case as defined in claim 1, wherein the intermediate plate is of a planar configuration and the cover includes a peripheral edge which encloses the intermediate plate.

* * * * *